US007728530B2

(12) United States Patent
Wang et al.

(10) Patent No.: US 7,728,530 B2
(45) Date of Patent: Jun. 1, 2010

(54) LED DRIVING CIRCUIT AND CONTROLLING METHOD THEREOF

(76) Inventors: Ji Wang, A2-504 Guanhaitai, Chuangye Lu, Nanshan District, Shenzhen, Guangdong Province, 518054 P.R. (CN); Yimin Zhang, B303 Ya Ju, Hui Yuan, Nanshan District, Shenzhen, Guangdong Province, 518054 P.R. (CN)

( * ) Notice: Subject to any disclaimer, the term of this patent is extended or adjusted under 35 U.S.C. 154(b) by 772 days.

(21) Appl. No.: 11/595,594

(22) Filed: Nov. 9, 2006

(65) Prior Publication Data

US 2007/0108916 A1 May 17, 2007

(30) Foreign Application Priority Data

Nov. 11, 2005 (CN) ..... 2005 1 0124707

(51) Int. Cl.
*G05F 1/00* (2006.01)

(52) U.S. Cl. ..... 315/291; 315/209 R; 315/307; 315/360

(58) Field of Classification Search ..... 315/209 R, 315/224, 225, 291, 307, 244, 245, 247, 308, 315/360–362
See application file for complete search history.

(56) References Cited

U.S. PATENT DOCUMENTS

| | | | | |
|---|---|---|---|---|
| 6,747,420 | B2 * | 6/2004 | Barth et al. | 315/291 |
| 7,176,668 | B2 * | 2/2007 | Oswald et al. | 323/285 |
| 7,276,861 | B1 * | 10/2007 | Shteynberg et al. | 315/291 |
| 7,358,706 | B2 * | 4/2008 | Lys | 323/222 |

* cited by examiner

*Primary Examiner*—Douglas W Owens
*Assistant Examiner*—Jimmy T Vu
(74) *Attorney, Agent, or Firm*—Beyer Law Group LLP

(57) ABSTRACT

The invention discloses an LED driving circuit and a controlling method thereof, comprising a power switch and a current sampling unit, as well as a voltage comparison unit for comparing the voltage obtained by the current sampling unit with a first reference voltage; an input voltage sampling unit for converting the sampled input voltage into a current signal; a timing unit for controlling the off-time of the power switch or presetting a fixed off-time; a logical unit for controlling the power switch by means of a power switch driving unit and for controlling the timing switch in the timing unit. The method for controlling the LED driving circuit comprises the step of modulating the off-time of the power switch with the input voltage or the step of presetting a fixed off-time. The invention can be used in LED light cluster driving with the power factor greater than 0.95.

14 Claims, 4 Drawing Sheets

LED DRIVING CIRCUIT AND CONTROLLING METHOD THEREOF

RELATED APPLICATION

The present application claims the priority of the Chinese Patent Application No. 200510124707.4, filed Nov. 11, 2005, titled "LED Driving Circuit and Controlling Method Thereof", which is incorporated herein by reference in its entirety.

FIELD OF THE INVENTION

The invention relates to a power supply driving circuit and a controlling method thereof, and in particular, to a driving circuit and controlling method for LED.

BACKGROUND OF THE INVENTION

With large power LEDs being widely used in lighting and illumination, power-type LED driving circuits are increasingly important. Additionally, the luminous intensity of an LED, which is a current-type semiconductor light emitting device, is determined by the current flowing through the LED. Therefore, a power supply, which provides a constant current for driving LEDs, is in earnest demand.

Currently, two kinds of methods are commonly used for driving LEDs by means of electric mains (220 V or 110 V alternating-current supplies). One is to take advantage of RC voltage drop. In this case, the efficiency is so low that supplying electricity to an LED of 1 W will consume power of 4-6 W in the grid; and the power factor is extremely low, up to about 0.2, which not only causes heavy pollution to the grid, but also significantly reduces the lifetime of LEDs. The other is to employ a conventional AC/DC switch power supply with a constant voltage to supply electricity. In this case, the efficiency is about 70% and the power factor about 0.6. Due to its bulkiness, the brightness consistency of LEDs used in batches is poor. In addition, EMI (ElectroMagnetic Interference) is severe, and thereby causes heavy pollution to the grid.

To solve the problems described above, a HV9910 Universal High Brightness LED Driver is now commercially available, which has the circuit as shown in FIG. 1. It is designed to convert a high voltage source (AC85-265V after rectification, or DC8-450V) into a constant current source for supplying electricity to high brightness LEDs in series or series-parallel connections. HV9910 controls pulse width modulation (PWM) with the peak current having a constant frequency, which uses small inductors and external switches to minimize the loss of LED drivers. Unlike a conventional PWM controller, it employs a simple on/off control to adjust the LED current, thus simplifying the design of the controlling circuit.

As compared with a conventional LED driver, such a HV9910 driver has many advantages, such as simple design, lower cost, high efficiency (up to 93% or higher) and convenient control, etc. However, it employs pulse width modulation (PWM), which demands an accurate network compensation design for the sampled feedback signals obtained from power circuits. Parameters of such a compensation loop are affected by IC internal parameters, parameters of power circuits and layout and distribution parameters of printed circuit boards. Hence, as the operating frequency increases, such a design becomes increasingly difficult. It not only causes the increase of the costs for IC itself and peripheral components, but also causes the decrease of the stability of mass production. Additionally, the power factor of such a HV9910 driver is also extremely low. Only by introducing an inactive power correction circuit (as indicated by the circuit in a dashed box of FIG. 2) in circuits employing HV9910 when the input power of an LED driver does not exceed 25 W, can the power factor be improved. Even so, its power factor can only be raised up to 0.85.

SUMMARY OF THE INVENTION

It is an object of the present invention to provide an LED driving circuit and a controlling method thereof, whereby the efficiency and power factor is improved, and the frequency and duty ratio of the current as well as the pulse is adjustable, and whereby disadvantages of an LED driving circuit that employs pulse width modulation (PWM) are overcome. To realize the object of the invention, the present invention employs the following technical solutions:

According to a first aspect of the invention, there is provided an LED driving circuit that, in addition to a power switch and a current sampling unit for sampling LED operating current, further comprises: a voltage comparison unit for comparing the voltage obtained by the current sampling unit with the voltage of a first reference voltage source; an input voltage sampling unit for converting input voltage into a current signal; a timing unit for controlling the off-time of the power switch based on the magnitude of the input voltage collected by the input voltage sampling unit; a logical unit for controlling the power switch by means of a power switch driving unit based on the comparison of the voltage comparison unit and the output signal of the timing unit, and for controlling the timing switch in the timing unit.

Preferably, the current sampling unit is a resistor or a current coupling device that is connected in series with the power switch. When the voltage obtained by the current sampling unit reaches the voltage of the first reference voltage source, the voltage comparison unit outputs a low level such that the level at the output end of the logical unit is changed, and the power switch is switched off via the power switch driving unit connected to the output end. The input voltage sampling unit is a resistor connected to the voltage input end. The timing unit further comprises: a timing capacitor that is connected in series with the input voltage sampling unit and then grounded, a timing switch connected in parallel with the timing capacitor, and an operational amplifier, the inphase terminal of which is grounded via a second reference voltage source, and the outphase terminal of which is connected between the input voltage sampling unit and the timing capacitor. The voltage comparison unit is preferably an operational amplifier, the outphase terminal of which is connected to the high voltage terminal of the current sampling unit and the inphase terminal of which is grounded via the first reference voltage source. The logical unit is preferably a trigger composed of gate circuits, one of its input ends being connected to the output of the voltage comparison unit, the other to the output of the timing unit; one of its output ends being connected to the power switch driving unit, and the other to the timing switch. The power switch driving unit is preferably a totem pole circuit. The LED driving circuit may be a discrete component circuit or may be an integrated circuit, preferably an integrated circuit.

According to a second aspect of the invention, there is also provided an LED driving circuit that, in addition to a power switch and a current sampling unit for sampling LED operating current, further comprises: a voltage comparison unit for comparing the voltage obtained by the current sampling unit with the voltage of a first reference voltage source; a timing unit for setting a fixed off-time for the power switch; a logical unit for controlling the power switch by means of a power switch driving unit, based on the comparison of the voltage comparison unit and the output signal of the timing unit, and for controlling the timing switch in the timing unit.

Preferably, the current sampling unit is a resistor or a current coupling device that is connected in series with the power switch. When the voltage obtained by the current sampling unit reaches the voltage of the first reference voltage source, the voltage comparison unit outputs a low level such that the level at the output end of the logical unit is changed, and the power switch is switched off via the power switch driving unit connected to the output end. The timing unit further comprises: a timing resistor and a timing capacitor that are connected in series with each other and then connected in parallel with a third reference voltage source, a timing switch connected in parallel with the timing capacitor, and an operational amplifier, the inphase terminal of which is grounded via a second reference voltage source, and the outphase terminal of which is connected between the timing resistor and the timing capacitor. The voltage comparison unit is preferably an operational amplifier, the outphase terminal of which is connected to the high voltage terminal of the current sampling unit, and the inphase terminal of which is grounded via the first reference voltage source. The logical unit is preferably a trigger composed of gate circuits, one of its input ends being connected to the output of the voltage comparison unit, the other to the output of the timing unit; one of its output ends being connected to the power switch driving unit, and the other to the timing switch in the timing unit. The power switch driving unit is preferably a totem pole circuit. The LED driving circuit may be a discrete component circuit or may be an integrated circuit, preferably an integrated circuit.

According to a third aspect of the invention, there is provided a method for controlling a LED driving circuit, comprising the following steps of: sampling LED operating current; comparing the voltage indicative of the magnitude of the sampled LED operating current with the voltage of a first reference voltage source to control the on-time of the power switch that controls the power suppling of LEDs; sampling input voltage and controlling the off-time of the power switch with a sampled voltage; or setting, by the timing unit, a fixed off-time for the power switch. When modulated with the input voltage, the off-time of the power switch is prolonged when the input voltage is low, while shortened when the input voltage is high; or, when a fixed off-time is to be set for the power switch, the off-time of the power switch may be preset.

The LED driving circuit and controlling method according to the present invention achieves the advantageous technical effects as follows:

1. having a simple circuit structure and low manufacturing cost;

2. providing a pulse current with a constant valid value, and with the frequency and duty ratio of the current as well as the pulse adjustable;

3. having a small volume, high efficiency and high power factor. This driving circuit is designed small enough to be directly installed in an ordinary lamp holder, such that LEDs may directly substitute for the currently used luminaire. As the off-time is modulated with the input voltage, the power factor may thereby be higher than 0.95, and the efficiency than 95%.

4. having enhanced LED luminous intensity and prolonged LED lifetime. Since the constant current provided by the present invention is fully controllable, the maximum current flowing through LEDs may be adjusted in a manner to increase the LED intensity, based on the performance of LED. Due to the use of pulse energization, LEDs are operated intermittently, which in turn prolongs the lifetime thereof. For example, in case of a 0.5 duty ratio, the lifetime of an LED may be twice of the original. Meanwhile, when operated at high frequencies, the driving circuit is capable of sufficiently utilizing the afterglow effect of the phosphor in LEDs, as a result of which no flickering of light occurs, and moreover the ratio of energy consumption to light emission of LED is further improved.

BRIEF DESCRIPTION OF THE DRAWINGS

These and other advantages and features of the present invention will be more fully disclosed or rendered by the following detailed description of the preferred embodiments of the invention, which is to be considered together with the accompanying drawings wherein like numbers refer to like or similar parts and further wherein.

DETAILED DESCRIPTION OF THE INVENTION

Example 1

Figure 1:
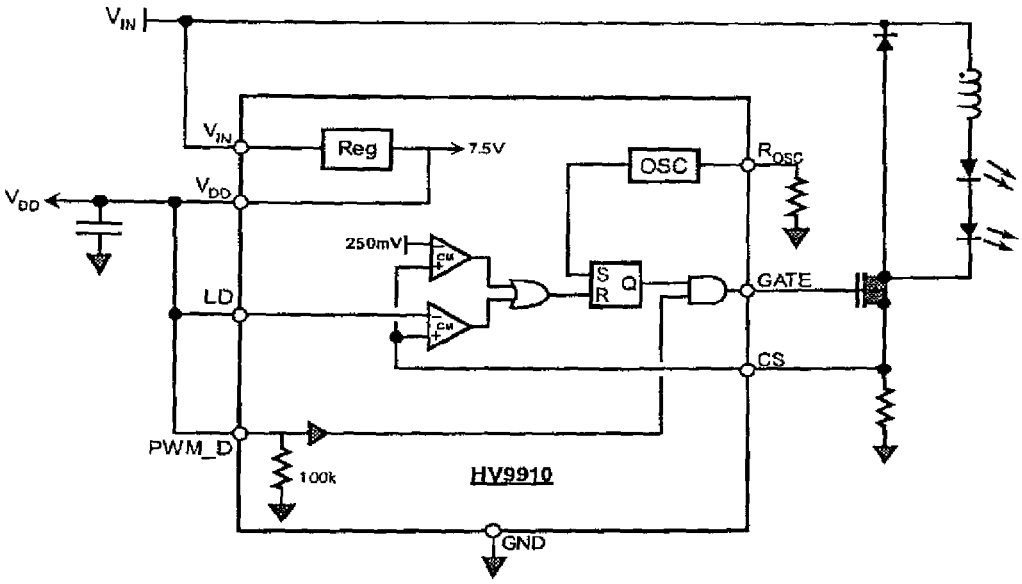
Fig. 1 (Prior Art)
FIG. 1 is a schematic diagram of a HV9910 universal high brightness LED driver circuit.
Figure 2:
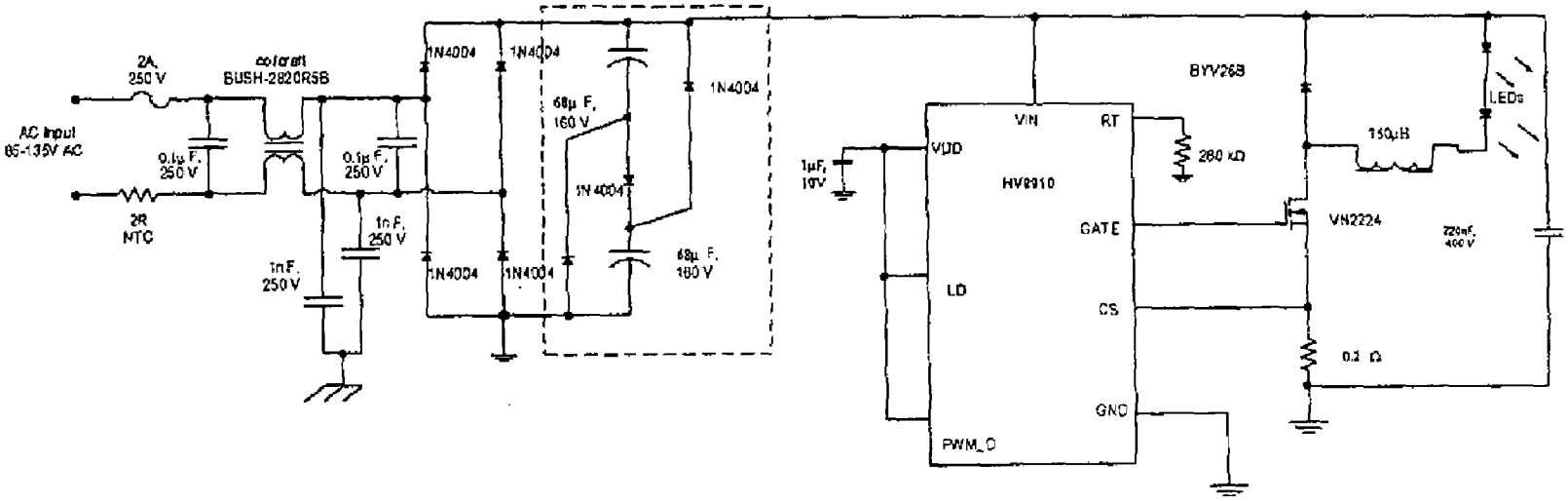
Fig. 2 (Prior Art)
FIG. 2 shows a typical application circuit of a HV9910 universal high brightness LED driver.
Figure 3:
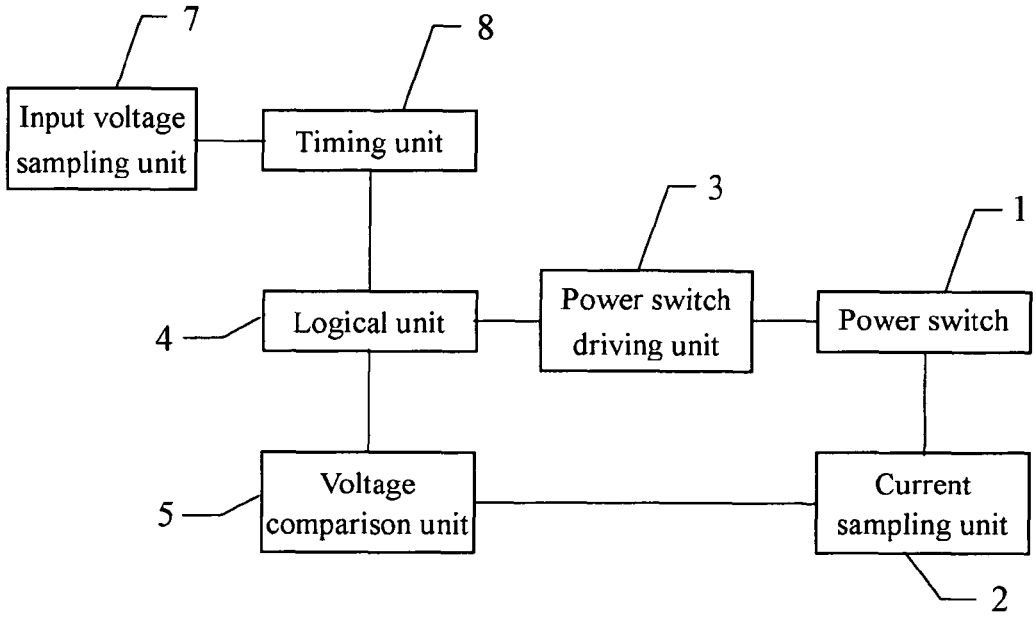
FIG. 3 is a structural block diagram of an LED driving circuit according to the invention.

As shown in FIG. 3, in addition to a power switch 1 and a current sampling unit 2 for sampling LED operating current, there are further comprised: a voltage comparison unit 5 for comparing the voltage obtained by the current sampling unit 2 with the voltage of a first reference voltage source 6 (see FIG. 5); an input voltage sampling unit 7 for converting the sampled input voltage into a current signal; a timing unit 8 for controlling the off-time of the power switch 1 based on the magnitude of the input voltage collected by the input voltage sampling unit 7; a logical unit 4 for controlling the power switch 1 by means of a power switch driving unit 3, based on the comparison of the voltage comparison unit 5 and the output signal of the timing unit 8, and for controlling the timing switch 10 in the timing unit 8.

Figure 5:
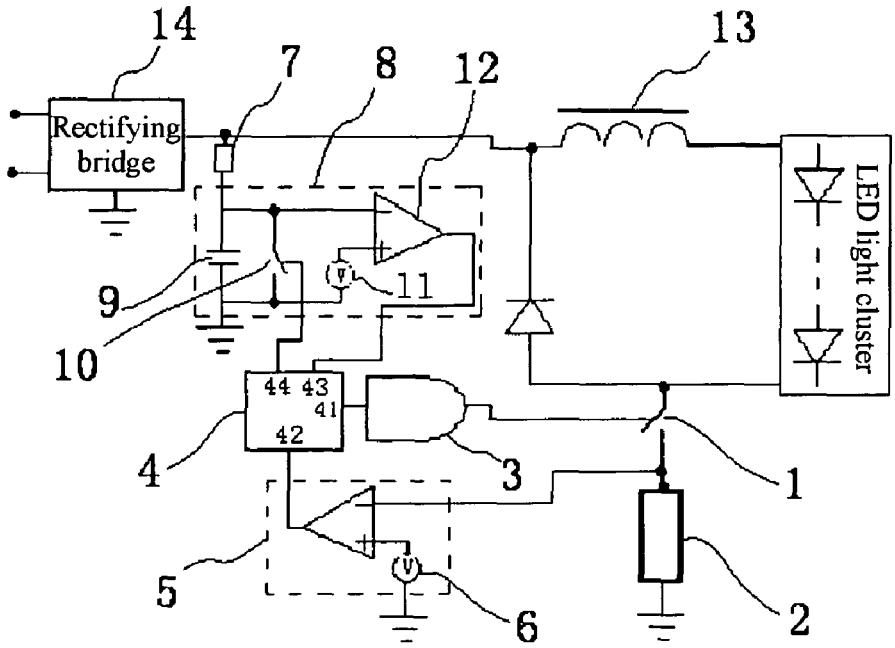
FIG. 5 is a schematic diagram of an LED driving circuit in a particular application according to the invention.

As shown in FIG. 5, the current sampling unit 2 is a resistor or a current coupling device connected in series with the power switch 1, preferably a resistor in this embodiment, for converting the sampled current signal into a voltage signal. When the voltage obtained by the current sampling unit 2 reaches the voltage of the first reference voltage source 6, the voltage comparison unit 5 outputs a low level such that the level at the first output end 41 of the logical unit 4 is changed, and the power switch 1 is switched off via the power switch driving unit 3 connected to the first output end 41.

In this embodiment, the power switch driving unit 3 is a totem pole circuit, and the input voltage sampling unit 7 is a resistor. The timing unit 8 further comprises: a timing capacitor 9 that is connected in series with the input voltage sampling unit 7 and then grounded, a timing switch 10 connected in parallel with the timing capacitor 9, and an operational amplifier 12, the inphase terminal of which is grounded via a second reference voltage source 11, and the outphase terminal of which is connected between the input voltage sampling unit 7 and the timing capacitor 9.

In this embodiment, the voltage comparison unit 5 is an operational amplifier, the outphase terminal of which is connected to the high voltage terminal of the current sampling unit 2, and the inphase terminal of which is grounded via the first reference voltage source 6.

The logical unit 4 is a trigger composed of gate circuits. Its first input end 42 is connected to the output of the voltage comparison unit 5, while its second input end 43 is connected to the output of the timing unit 8; its first output end 41 is connected to the power switch driving unit 3, while its second output end 44 is connected to the timing switch 10. Although the circuits in this embodiment may be in the form of discrete component circuits, all of the parts except the power switch are preferably integrated circuits.

Example 2

Figure 4:
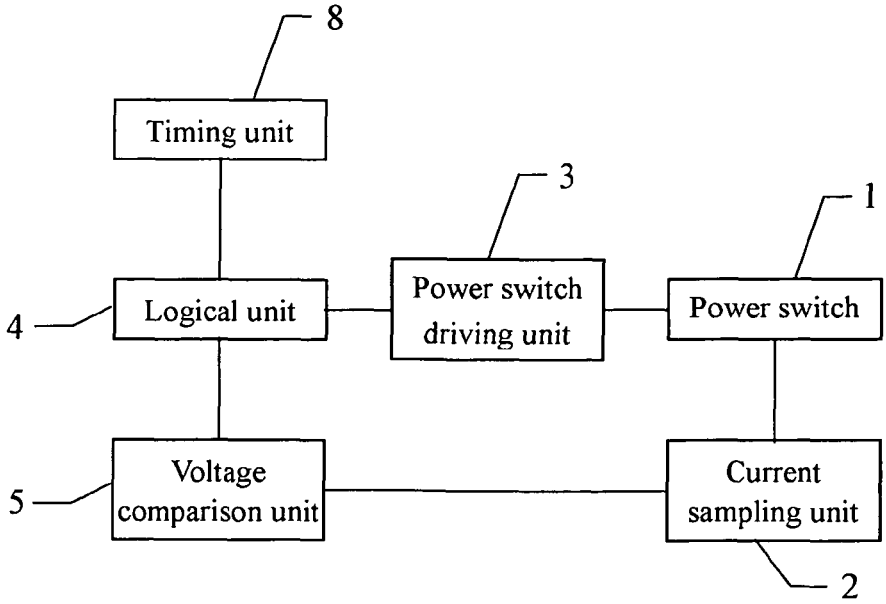
FIG. 4 is a structural block diagram of another LED driving circuit according to the invention.

As shown in FIG. 4, in addition to a power switch 1 and a current sampling unit 2 for sampling LED operating current, there are further comprised: a voltage comparison unit 5 for comparing the voltage obtained by the current sampling unit 2 with the voltage of a first reference voltage source 6 (see FIG. 6); a timing unit 8 for setting a fixed off-time for the power switch 1; a logical unit 4 for controlling the power switch 1 by means of a power switch driving unit 3, based on the comparison of the voltage comparison unit 5 and the output signal of the timing unit 8, and for controlling the timing switch 10 in the timing unit 8.

Figure 6:
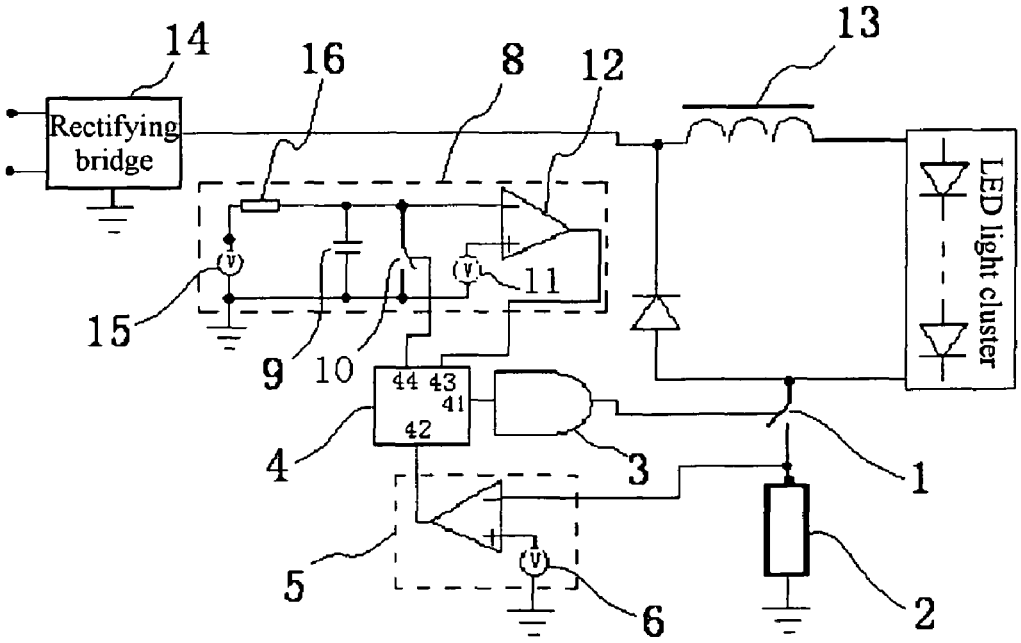
FIG. 6 is a schematic diagram of another LED driving circuit in a particular application according to the invention.

As shown in FIG. 6, the current sampling unit 2 is a resistor or a current coupling device connected in series with the power switch 1, preferably a resistor in this embodiment, for converting the sampled current signal into a voltage signal. When the voltage obtained by the current sampling unit 2 reaches the voltage of the first reference voltage source 6, the voltage comparison unit 5 outputs a low level such that the level at the first output end 41 of the logical unit 4 is changed, and the power switch 1 is switched off via the power switch driving unit 3 connected to the first output end 41.

In this embodiment, the power switch driving unit 3 is a totem pole circuit. The timing unit 8 further comprises: a timing resistor 16 and a timing capacitor 9 that are connected in series with each other and then connected in parallel with a third reference voltage source 15, a timing switch 10 connected in parallel with the timing capacitor 9, and an operational amplifier 12, the inphase terminal of which is grounded via a second reference voltage source 11, and the outphase terminal of which is connected between the timing resistor 16 and the timing capacitor 9.

In this embodiment, the voltage comparison unit 5 is an operational amplifier, the outphase terminal of which is connected to the high voltage terminal of the current sampling unit 2, and the inphase terminal of which is grounded via the first reference voltage source 6.

The logical unit 4 is a trigger composed of gate circuits. Its first input end 42 is connected to the output of the voltage comparison unit 5, while its second input end 43 is connected to the output of the timing unit 8; its first output end 41 is connected to the power switch driving unit 3, while its second output end 44 is connected to the timing switch 10. Although the circuits in this embodiment may be in the form of discrete component circuits, all of the parts except the power switch are preferably integrated circuits.

Operating Principle and Controlling Method

With respect to Embodiment 1, as shown in FIG. 5, a power inductor 13 is firstly charged by using a DC voltage or a rectified DC voltage, and the current for charging is sampled by a resistor or a current mutual inductor and fed back to the driving circuit. When the current sampled voltage reaches the voltage of the first reference voltage source 6, the voltage comparator 5 outputs a low level. The output level at the output end 41 is changed via the logical unit 4, whereby the power switch 1 is switched off, and charging the power inductor 13 is stopped. In the meantime, the logical unit 4 signals to turn off the timing switch 10, and the timing capacitor 9 thereby starts to be charged. When the level of the timing capacitor 9 reaches the voltage of the second reference voltage source 11, the timing circuit 8 outputs a low level. The level output by the power switch driving unit 3 is changed again via the logical circuit 4, whereby the power switch 1 is turned on. The off-time of the power switch 1 is modulated by the driving circuit. When the modulated off-time period expires, the process for charging the power inductor 13 begins again. A rectifying bridge 14 is required in case of a AC supply, wherein the rectified input voltage is sampled to modulate the off-time, such that the off-time is prolonged when the input voltage is low, and shortened when the input voltage is high. Thus, the average input current forms a sine wave with identical phases and input voltages. Hence, an input power factor higher than 0.95 is resulted. In case of determining the off-time by charging and discharging the timing capacitor, as the charging currents vary with different input voltages, the modulation of the off-time via the input voltage is thereby achieved.

With respect to Embodiment 2, as shown in FIG. 6, the operating processes of all of the parts except the timing unit 8 are basically the same as those in Embodiment 1. With respect to the timing unit 8 as shown in Embodiment 2, the third reference voltage source 15 charges and discharges the timing capacitor 9 via the timing resistor 16, whereby the flip time for the output level of the voltage comparator composed of the operational amplifier 12 and the second reference voltage source 11 is under control. Based thereon, the off-time of the power switch 1 is controlled via the logical unit 4 and the power switch driving unit 3. Therefore, where the magnitudes of the third reference voltage source 15, the timing resistor 16 and the timing capacitor 9 are preset, it means that a time constant for the timing circuit is preset. More specifically, it is to say the fixed off-time of the power switch 1 is preset.

It should be specially noted that such terms as "first", "second", "third" or the like used in the specification and the appended claims of the present invention are illustrative only and can be otherwise.

The present invention is hereinabove described in great details through specific and preferred embodiments. However, those skilled in the art should understand that these embodiments are by no means restrictive to the present invention. Various units in the LED driving circuit of the invention may also be replaced with other specific circuits having the same functions. For example, all of the circuits that may implement the same logical functions can be used as the logical unit of the invention; all of the devices or circuits that may implement the same comparison functions can be used as the voltage comparison unit of the invention; and all of the devices or circuits that may implement the same timing function can be used as the timing unit of the invention, and so on.

Anyhow, various modifications, variations or adjustments can be made to the present invention without departing from the scope as defined in the appended claims, and are intended to fall within the scope of the invention.

The invention claimed is:

1. LED driving circuit including a power switch and a current sampling unit for sampling LED operating current, said circuit further comprising:

a voltage comparison unit for comparing the voltage obtained by the current sampling unit with the voltage of a first reference voltage source;

an input voltage sampling unit for converting the sampled input voltage into a current signal;

a timing unit for controlling the off-time of the power switch based on the magnitude of the input voltage collected by the input voltage sampling unit, wherein the timing unit further includes a timing capacitor that is connected in series with the input voltage sampling unit and then grounded, a timing switch connected in parallel with the timing capacitor, and an operational amplifier, the inphase terminal of which is grounded via a second reference voltage source and the outphase terminal of which is connected between the input voltage sampling unit and the timing capacitor; and a logical unit for controlling the power switch by means of a power switch driving unit, based on the comparison of the voltage comparison unit and the output signal of the timing unit, and for controlling the timing switch in the timing unit.

2. The LED driving circuit according to claim 1, wherein the input voltage sampling unit is a resistor connected to a voltage input end.

3. The LED driving circuit according to claim 1, wherein the current sampling unit is a resistor or a current coupling device that is connected in series with the power switch.

4. The LED driving circuit according to claim 1, wherein the voltage comparison unit is an operational amplifier, the outphase terminal of which is connected to the high voltage terminal of the current sampling unit, and the inphase terminal of which is grounded via the first reference voltage source.

5. The LED driving circuit according to claim 1, wherein the power switch driving unit is a totem pole circuit.

6. The LED driving circuit according to claim 1, wherein the logical unit is a trigger composed of gate circuits, one of its input ends being connected to the output of the voltage comparison unit, the other to the output of the timing unit; one of its output ends being connected to the power switch driving unit, and the other to the timing switch in the timing unit.

7. The LED driving circuit according to claim 1, wherein the circuit is either a discrete component circuit or an integrated circuit.

8. An LED driving circuit including a power switch and a current sampling unit for sampling LED operating current, further comprising:

a voltage comparison unit for comparing the voltage obtained by the current sampling unit with the voltage of a first reference voltage source;

a timing unit for setting a fixed off-time for the power switch, wherein the timing unit further includes a timing resistor and a timing capacitor that are connected in series with each other and then connected in parallel with a third reference voltage source, a timing switch connected in parallel with the timing capacitor, and an operational amplifier, the inphase terminal of which is grounded via a second reference voltage source, and the outphase terminal of which is connected between the timing resistor and the timing capacitor; and a logical unit for controlling the power switch by means of a power switch driving unit, based on the comparison of the voltage comparison unit and the output signal of the timing unit, and for controlling the timing switch in the timing unit.

9. The LED driving circuit according to claim 8, wherein the current sampling unit is a resistor or a cunent coupling device that is connected in series with the power switch.

10. The LED driving circuit according to claim 8, wherein the voltage comparison unit is an operational amplifier, the outphase terminal of which is connected to the high voltage terminal of the current sampling unit, and the inphase terminal of which is grounded via the first reference voltage source.

11. The LED driving circuit according to claim 8, wherein the power switch driving unit is a totem pole circuit.

12. The LED driving circuit according to claim 8, wherein the logical unit is a trigger composed of gate circuits, one of its input ends being connected to the output of the voltage comparison unit, the other to the output of the timing unit; one of its output ends being connected to the power switch driving unit, and the other to the timing switch in the timing unit.

13. The LED driving circuit according to claim 8, wherein the circuit is either a discrete component circuit or an integrated circuit.

14. A method for controlling an LED driving circuit, said method comprising:

sampling LED operating current;

comparing the voltage indicative of the magnitude of the sampled LED operating current with the voltage of a first reference voltage source to control the on-time of a power switch that controls the power supplying of LEDs;

sampling input voltage, and controlling the off-time of the power switch with a sampled voltage; or setting, by a timing unit, a fixed off-time of the power switch, wherein, when modulated with the input voltage, the off-time of the power switch is prolonged when the input voltage is low, while shortened when the input voltage is high, and when a fixed off-time is to be set for the power switch, the off-time of the power switch being preset.

* * * * *